United States Patent [19]

Drozd

[11] Patent Number: 4,726,483

[45] Date of Patent: Feb. 23, 1988

[54] TAMPER-EVIDENT CLOSURE EMPLOYING INNER CAP AND OUTER SLEEVE AND CONTAINER UTILIZED THEREWITH

[75] Inventor: Edward Drozd, Lake Hiawatha, N.J.

[73] Assignee: Captive Plastics, Inc., Piscataway, N.J.

[21] Appl. No.: 51,443

[22] Filed: May 18, 1987

[51] Int. Cl.[4] ..... B65D 41/34

[52] U.S. Cl. ..... 215/252; 215/31

[58] Field of Search ..... 215/252, 31

[56] References Cited

U.S. PATENT DOCUMENTS

| | | | |
|---|---|---|---|
| 1,938,063 | 12/1933 | Burke | 215/252 |
| 2,124,873 | 7/1938 | Conner | 215/252 X |
| 3,329,295 | 7/1967 | Fields | 215/252 |
| 3,455,478 | 7/1969 | Fields et al. | 215/252 |
| 3,463,341 | 8/1969 | Fields | 215/252 |
| 4,343,408 | 8/1982 | Csaszar | 215/252 X |
| 4,352,436 | 10/1982 | Chartier | 215/252 |
| 4,461,390 | 7/1984 | Csaszar | 215/252 |
| 4,461,391 | 7/1984 | Davis | 215/252 |
| 4,489,843 | 12/1984 | Drozd | 215/252 |
| 4,529,096 | 7/1985 | Chartier et al. | 215/252 |
| 4,537,319 | 8/1985 | Whitney | 215/252 |
| 4,541,536 | 9/1985 | Davis et al. | 215/252 |
| 4,577,770 | 3/1986 | Wright | 215/252 |

FOREIGN PATENT DOCUMENTS

| | | | |
|---|---|---|---|
| 1536459 | 7/1968 | France | 215/252 |

*Primary Examiner*—Donald F. Norton

*Attorney, Agent, or Firm*—Caesar, Rivise, Bernstein, Cohen & Pokotilow, Ltd.

[57] ABSTRACT

A unitary tamper-evident closure includes an inner threaded cap member (16) interconnected by circumferentially spaced-apart, radially extending break-away tabs (18) to an outer skirt (14) that is concentric with the inner cap member (16). The outer skirt includes a plurality of circumferentially spaced-apart first abutment members (20) that cooperate with circumferentially spaced-apart abutment members (22) on the inner cap member to transmit a driving force from the outer skirt to the inner cap member when the closure is being rotated onto the threaded neck (24) of a container (10). The first abutment members (20) also cooperate with the abutment members (22) for imparting axially oriented forces to the inner cap member (16) and outer skirt (14) in opposite directions when the closure initially is unthreaded from the neck (24). In the preferred embodiment of the invention the outer skirt is provided with a plurality of circumferentially spaced-apart second abutment members (26) for cooperating with a plurality of circumferentially spaced-apart locking members (28) on a container (10) to assist in maintaining the closure in a closed condition, and also to assist in applying an axial force to the outer skirt (14) for the purpose of assisting in fracturing the break-away tabs (18) that interconnect the inner cap member (16) to the outer skirt (14).

A preferred container (10) in accordance with this invention is a unitary member having a neck (24) with a threaded section adjacent the upper end thereof, a circumferentially continuous, radially extending collar (68) terminating in a peripheral, circumferential edge disposed radially outward of the threads, and a plurality of circumferentially spaced-apart locking members (28) below the collar and having portions extending radially beyond the peripheral edge of the collar.

10 Claims, 5 Drawing Figures

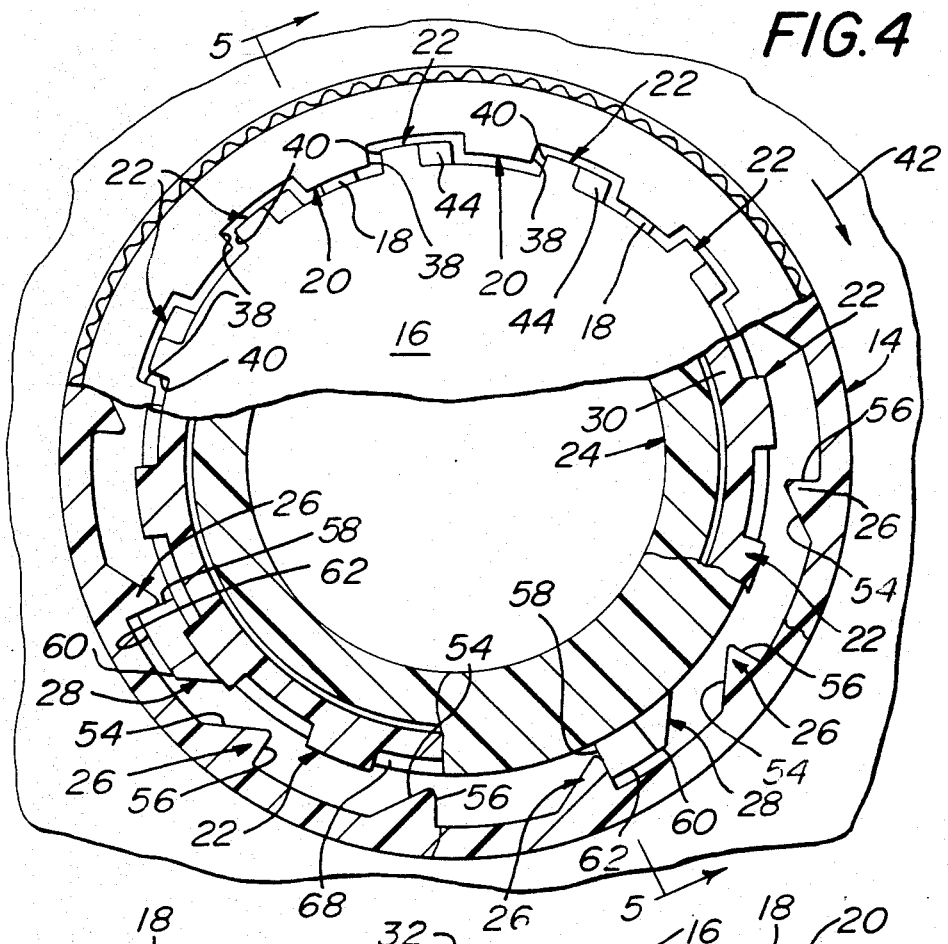
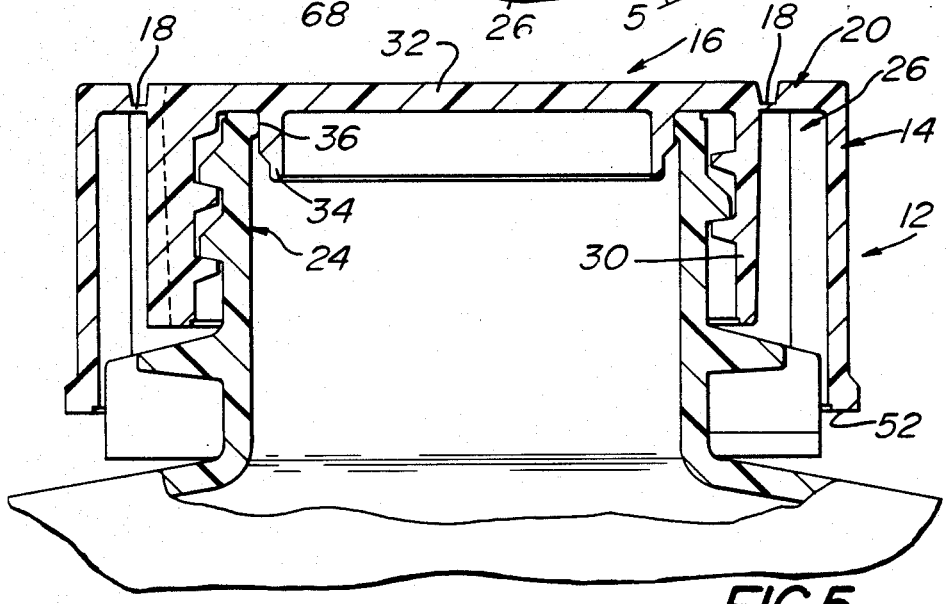
FIG.5

TAMPER-EVIDENT CLOSURE EMPLOYING INNER CAP AND OUTER SLEEVE AND CONTAINER UTILIZED THEREWITH

BACKGROUND OF THE INVENTION

This invention relates generally to a tamper evident closure and container utilizable therewith, and more specifically to a tamper-evident closure having an inner cap and outer sleeve, and a container employing closure locking members that cooperate with abutment members on the outer sleeve of the closure for aiding in fracturing break-away tabs that interconnect the inner cap and outer sleeve.

The prior art is replete with tamper-evident closures in which a member of the closure, such as a lower skirt or band, is designed to become separated from an upper cap section when the closure is removed from a container for the first time. Thus, if the closure is opened prior to the package being purchased by a consumer, the separated (or missing) skirt or band provides a visual indication that the package has been so opened.

Representative of the above-type of closures are those disclosed in U.S. Pat. Nos. 4,577,770 (Wright); 4,529,096 (Chartier et al.); 4,461,390 (Csaszar); 4,352,436 (Chartier et al.); 4,343,408 (Csaszar); 4,147,268 (Patel et al.); 3,944,102 (Grau); 4,126,240 (Brach); 3,463,341 (Fields); 3,455,478 (Fields et al.); 3,329,295 (Fields); 4,461,391 (Davis) and French No. 1,536,459 (Rapeaud et al.).

In the embodiment shown in FIG. 3 of Davis U.S. Pat. No. 4,461,391 cooperating abutment surfaces 20 and 22 associated with the upper cap and lower skirt, respectively, engage each other as the cap is threaded onto a closure, to thereby prevent interconnecting tabs 4 from fracturing. However, when the cap is unscrewed, inclined surfaces 19 of the cap ride along inclined surfaces 21 of the skirt to thereby cause relative vertical movement between said cap and skirt, thereby assisting in fracturing the tabs 4. A similar arrangement appears to be disclosed in Rapeaud et al. (French Patent No. 1,536,459).

Multi-piece closures having inner and outer, generally concentric cap and skirt members interconnected by break-away tabs are disclosed in U.S. Pat. No. 1,938,063, issued to Burke, and U.S. Pat. No. 2,124,873, issued to Conner. In the Burke device an inner cap 15 is screwed onto the finish of a bottle, and an outer sealing member 18 (i.e., a skirt) is screwed onto the thread 14 of the bottle over the cap 15. Thereafter a projection 17 passing through hole 21 of a closure member 20 is spun over the closure member to thereby lock the closure member to the cap 15. The closure member 20 is connected to the sealing member 18 through a recessed, weakened, annular section 22.

When the Burke device is turned in a right-handed direction, the caming thread 14 on the container causes the sealing member 18 thereof to move axially relative to the inner cap 15. This places an axial tension on the locking means 17 and causes the recess 22 to fracture, thereby separating the skirt member 18 from the closure member 20 and attached inner cap 15. The Burke device is somewhat complex, being made from four separate elements (i.e., cap 15, projection 17, sealing member 18 and closure member 20.)

In the device disclosed in Conner, U.S. Pat. No. 2,124,873, in FIG. 6, a primary inner closure or cap 7*a* includes an upward extension 17 to which a dome 19 of an outer indicator member 4*a* is permanently attached. The dome 19 is interconnected to an outer peripheral skirt of the indicator member through an annular zone of weakness 21. In this device upward projecting cams 22 on the top of the inner cap 7*a* cooperate with downwardly projecting cams 23 on the outer skirt of the indicator member 4*a* to cause relative axial movement between the outer skirt of the indicator member 4*a*, on the one hand, and the inner cap 7*a* and the dome 19 connected thereto, on the other hand. This relative axial movement causes the zone of weakness 21 to fracture, thereby separating the outer skirt of the indicator member 4*a* from the dome 19.

The Conner device, like the Burke device described above, is constructed from more than one separately formed element, and therefore is somewhat complex. Moreover, neither the Burke construction nor the Conner construction employ cooperating projections on the outer skirt and inner cap for the purpose of assisting in the cap closing operation.

To the best of applicant's knowledge no one has designed or developed, prior to this invention, a unitary, tamper-evident closure formed of an inner cap member interconnected to a concentrically mounted outer sleeve by break-away tabs, and wherein the closure can be applied to a container by conventional capping equipment, without causing the break-away tabs to fracture. It is to such a unitary closure and cooperating container that the present invention is directed.

OBJECTS OF THE INVENTION

It is a general object of this invention to provide a unitary, tamper-evident closure which can be molded in an easily and reliable manner.

It is a further object of this invention to provide a unitary, tamper-evident closure formed of an inner threaded cap member connected through break-away tabs to a concentrically positioned outer skirt member, and wherein the closure can be applied by conventional capping equipment to a container without fracturing the tabs.

It is a further object of this invention to provide a unitary, tamper-evident closure employing an inner threaded cap member connected through break-away tabs to a concentrically mounted outer skirt member, and wherein the tabs are broken when the closure initially is unscrewed from a cooperating container, to thereby separate the outer skirt member from the inner cap member to provide a visual indication that the closure has been opened.

It is a further object of this invention to provide a unitary closure having an inner threaded cap member interconnected through break-away tabs to an outer concentric skirt member, wherein easy and reliable means are provided to insure that the break-away tabs fracture when the closure initially is removed from a cooperating container.

It is a further object of this invention to provide a container which cooperates in an easy and reliable manner to assist in fracturing break-away tabs between an inner threaded cap member and an outer concentric skirt member of a closure, when the closure initially is removed from the container. .

It is a further object of this invention to provide a container which is designed to cooperate with a tamper-evident closure having an inner threaded cap member interconnected through break-away tabs to an outer concentric skirt member, wherein the container cooperates with the closure to maintain the closure in a closed condition, and to preclude opening the closure unless the interconnecting tabs between the inner cap member and outer skirt member are fractured.

DISCLOSURE OF THE INVENTION

The above and other objects of this invention are achieved with a unique unitary closure including an inner cap having a threaded peripheral wall adapted to cooperate with complimentary threads on the neck of a container and an outer skirt having a peripheral wall radially aligned with the peripheral wall of the cap and being interconnected to said cap through a plurality of circumferentially spaced-apart, radially extending break-away tabs. Cooperating abutment means are provided on the inner cap and outer skirt, respectively, said abutment means including first cooperating driving surfaces for engaging each other when the closure is being screwed onto a container, to cause said inner cap and outer skirt to move as a single unit to prevent fracturing of the break-away tabs. The cooperating abutment means also include caming surfaces for assisting in effecting relative axial movement between the inner cap and outer skirt when the closure initially is unscrewed from the neck of a container, to thereby stress the break-away tabs and cause them to fracture. This separates the inner cap from the outer skirt, thereby providing a visual indication that the closure has been opened.

In a preferred embodiment of this invention the outer skirt includes second abutment means including cam surfaces adjacent the lower axial end of the skirt which are adapted to engage cooperating cam surfaces of locking members on the container, to thereby assist in affecting relative axial movement between the inner cap and outer skirt when the closure initially is removed from the container.

The unique container of this invention includes a circumferentially extending collar located below the threads on the neck thereof, and a plurality of locking members circumferentially spaced-apart about the neck of the container in a position immediately below the collar. The circumferential collar is adapted to cooperate with inwardly facing surfaces of the outer skirt of the closure to prevent the skirt from being manually deformed into a non-round configuration which might permit the skirt to move past the locking members without the cam surfaces adjacent the lower end of the skirt engaging cooperating cam surfaces on the locking members. The locking members also are provided with horizontally facing cam surfaces which cooperate with horizontally facing cam surfaces of the second abutment means to permit the outer skirt to move into locking engagement with the locking members, without causing relative axial movement between the inner cap and outer skirt.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 4. is a plan view of FIG. 1, with parts broken away to illustrate the cooperative arrangement of elements at three different axial locations along the closure; and FIG. 5 is a sectional view taken along line 5—5 of FIG. 4.

DESCRIPTION OF THE PREFERRED EMBODIMENT OF THE INVENTION

Figure 1:
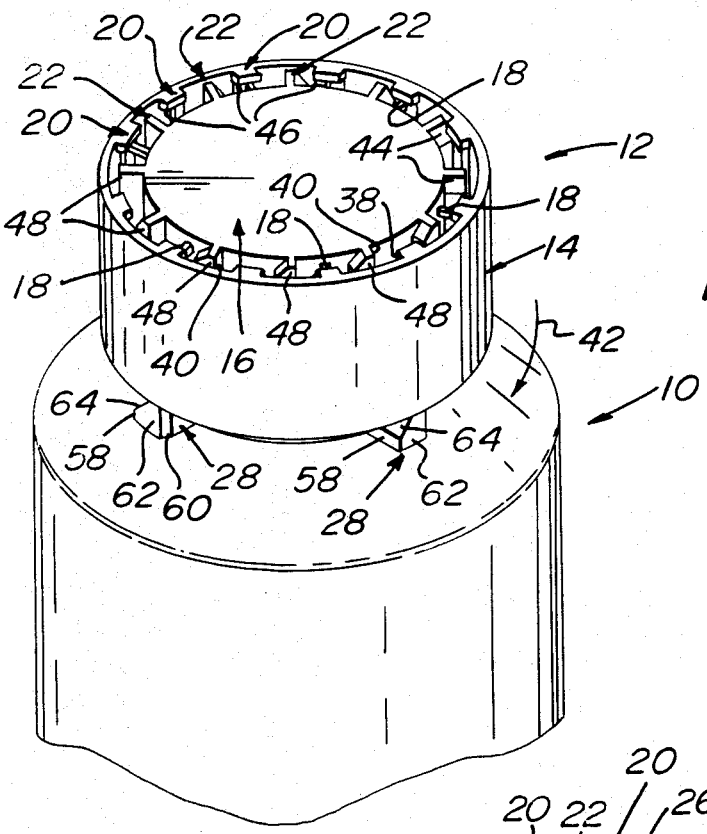
FIG. 1 is a partial isometric view showing the unique unitary closure of this invention partially threaded onto the neck of a cooperating container of this invention.

Referring now in greater detail to the various figures of the drawings wherein like reference characters refer to like parts, a unique container 10 and unitary tamper-evident closure 12 embodying the present invention are generally shown in FIG. 1. The unitary closure basically comprises an outer skirt 14 connected to an inner threaded cap member 16 by a plurality of circumferentially spaced-apart, radially-extending break-away tabs 18. A plurality of first abutment means 20 on the outer skirt cooperate with a plurality of abutment means 22 on the inner cap to prevent the break-away tabs from fracturing when the closure is initially applied to threaded neck 24 of the container 10. These abutment means 20 and 22 also include surfaces to assist in causing the break-away tabs to fracture when the closure 12 initially is unscrewed from the threaded neck, as will be described in greater detail hereinafter.

The outer skirt 14 of the closure 12 also includes second abutment means 26 which extend axially downward from the first abutment means 20, and terminate adjacent the lower surface of the skirt for cooperating with a plurality of circumferentially spaced-apart closure locking members 28 on the container 10, to assist in fracturing the break-away tabs when the closure is being unscrewed. As will be explained in greater detail hereinafter, these locking members 28 also are designed to cooperate with the second abutment means 26 on the outer skirt to permit the closure 12 to be threadedly secured onto the neck of the container, without creating break-away, tab-fracturing forces between the outer skirt 14 and inner cap member 16 of the closure.

Referring initially to FIG. 5 the outer skirt 14 of the closure 12 is an annular member which is radially aligned with, and radially spaced from axially extending peripheral wall 30 of the cap member 16 (i.e., the skirt 14 and cap member 16 are concentrically disposed relative to each other). The cap member 16 includes an upper wall 32 having a downwardly extending annular hub 34 in the center thereof. This hub is pressed into sealing engagement with inwardly extending sealing nibs 36 adjacent the upper surface of the threaded neck 24 of the container, when the closure 12 is fully seated on said container.

As can be seen best in FIGS. 1, 4 and 5, the break-away tabs 18 are spaced circumferentially about the closure 12 and extend radially to interconnect the outer periphery of the inner cap member 16 to the inner periphery of the outer skirt 14. As can be seen in FIG. 5, these break-away tabs are located adjacent the upper wall 32 of the cap member 16.

Referring to FIGS. 1 and 4, the first abutment means 20 extending inwardly from the outer skirt 14 each have a substantially vertically oriented surface 38 for cooperating with a similar substantially vertically oriented surface 40 on each of the abutment means 22, which extend radially outward from the peripheral wall 30 of the inner cap member 16, when the closure is being rotated onto the threaded neck 24 of the container 10 in the direction of arrow 42 (FIGS. 1 and 4). Specifically, these cooperating surfaces 38 and 40 engage each other to thereby permit the rotational force applied to the outer skirt 14 to be imparted to the inner cap member 16, and thereby cause said outer skirt and inner cap to move as a single unit without fracturing the break-away tabs 18.

Figure 2:
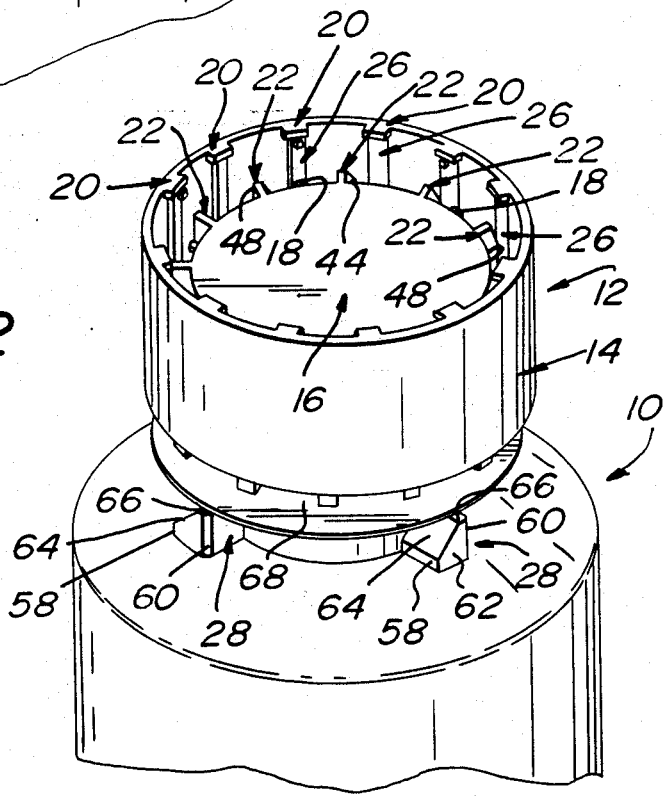
FIG. 2 is a partial isometric view similar to FIG. 1, but showing the outer skirt separated from the inner cap, resulting from the initial separation of the closure from the container.

Referring to FIGS. 1 and 2, each of the abutment means 22 on the inner cap 16 also includes an upper surface segment 44 which is inclined downwardly in the direction in which the closure 12 is rotated to thread said closure onto the neck 24 of the container. These inclined surface segments 44 engage cooperating surface means, in the form of a radially extending lower edge 46 on each of the first abutment means 20, when the closure 12 initially is unscrewed from the container 10. This forces the outer skirt 14 in an axially upward direction relative to the inner cap member 16 to thereby cause the break-away tabs 18 to fracture. This separates the outer skirt 14 from the inner cap member 16 to provide a visual indication that the closure has been opened (See FIG. 3).

Figure 3:
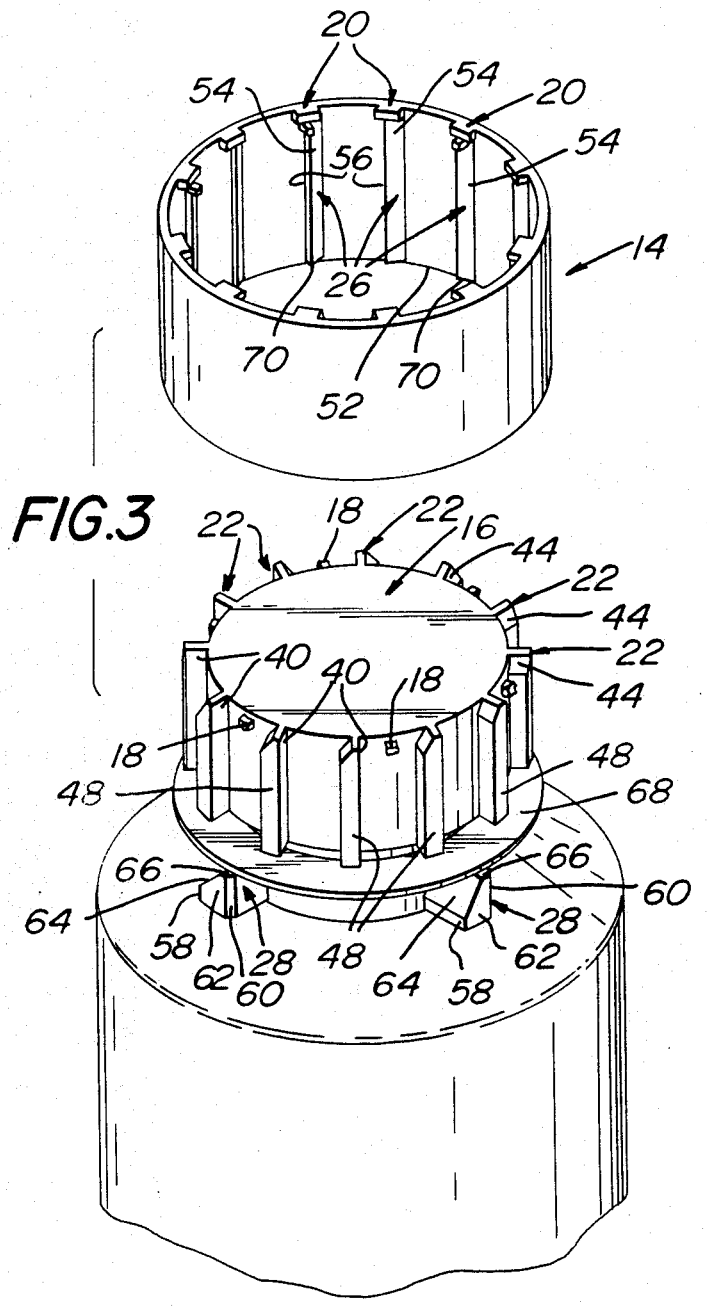
FIG. 3 is an exploded isometric view similar to FIG. 2, showing the appearance of the inner cap after the outer skirt has been separated and removed therefrom.

As can be seen best in FIGS. 1-3 the break-away tabs 18 are unitarially molded to the peripheral wall 30 of the inner cap member 16 in locations between the radially extending abutment means 22. This provides an added advantage; namely, that fractured segments of the tabs 18 on the cap member 16 will be located radially inward of the outer margins 48 (FIG. 3) of the abutment means 22. This prevents, or at least minimizes, the likelihood that a person will encounter jagged edges of the fractured tabs 18 when continuing to use the container, after the outer skirt 14 has been removed.

Referring to FIGS. 3 and 4, the axially extending second abutment members 26 on the outer skirt 14 are axially aligned with, and extend downwardly from the first abutment means 20 to a position adjacent lower surface 52 of said outer skirt. The second abutment members 26 each include an inclined cam surface 54 and a generally radially extending locking surface 56. As can be seen best in FIG. 4, the inclined cam surfaces 54 of the second abutment members 26 are inclined toward the inner periphery of the outer skirt 14, in the direction in which the closure is rotated to close the container 10, i.e., in the direction of arrow 42, and the locking surface 56 faces in the opposite direction.

Turning specifically to FIGS. 2 and 3, each of the circumferentially spaced-apart closure locking members 28 includes a locking surface 58 thereon. The locking surface 58 is generally vertically oriented and faces in the general direction in which the closure 12 is rotated to close the container.

Still referring to FIGS. 2 and 3, each of the closure locking members 28 also includes a vertically extending, rounded cam edge 60 joined to a vertically oriented outer peripheral wall 62. An inclined surface or ramp 64 joins the locking surface 58 of each of the closure locking members 28 with a generally horizontally extending, upper surface 66, which extends radially outward beyond a circumferential, radially extending collar 68 on the container 10.

As the closure 12 is screwed onto the threaded neck 24 of the container 10, in the direction of arrow 42, the inclined cam surface 54 on each of the second abutment members 26 rides over the vertically extending rounded edge 60 and outer peripheral wall 62 of the closure locking members 28 of the container. During this assembly operation the outer skirt 14 will expand sufficiently to move over the circumferential, radially extending collar 68, ride over the vertically extending rounded edge 60 and outer peripheral wall 62 of the locking members 28, until the locking surfaces 56 of the second abutment means 26 snap into overlying engagement with the locking surfaces 58 on the closure locking members 28. It should be noted again that during the assembly operation the cooperating, vertically oriented surfaces 38 and 40 of the abutment means 20 and 22 engage each other to cause the outer skirt 14 and the inner cap member 16 to move as a single unit, without fracturing the break-away tabs 18.

When a user attempts to unscrew the closure 12 he or she will be precluded by the collar 68 on the container from deforming the outer skirt 14 in a manner to permit the second abutment means 26 to move about the outer peripheral wall 62 and vertically extending rounded edge 60 of the closure locking members 28 on the container. If the user were able to so deform the skirt, it might be possible to physically remove the closure without causing the break-away tabs 18 to fracture. This would enable a person to tamper with the contents of the container, and then reassemble the closure on the container, without providing any visual indication that the product had been tampered with.

Instead, in accordance with this invention, when the closure 12 initially is unscrewed from the threaded neck 24 of the container 10, a lower edge 70 (FIG. 3) of one or more of the second abutment members 26 ride up the inclined surface or ramp 64 of one or more of the closure locking members 28 to assist in causing relative vertical or axial movement between the inner cap member 16 and the outer skirt 14. This vertical axial movement is assisted by the cooperation of the inclined surface 44 of the abutment means 22 on the inner cap member 16 with an adjacent edge of the first abutment means 20 extending radially inward from the outer skirt 14. Thus, in the preferred embodiment of this invention wherein the first abutment means 20 on the skirt 14 cooperates with the abutment means 22 on the cap member 16 to provide relative axial movement between said skirt and cap member, in combination with the cooperative action between the inclined ramps or surfaces 64 of the closure locking members 28 with adjacent lower edges 70 of the second abutment means 26, assurance is provided that the break-away tabs 18 fracture when the closure 12 is unscrewed from the container 10 for the first time.

The unitary closure 12 of this invention is unique, in that it is capable of being injection molded as a single unit with extremely simple injection molding equipment. In particular, due to the vertical orientation of the various elements there is no need to design the mold sections with parting lines to permit movement of the sections in a direction normal to the direction in which the closure 12 is removed from the mold.

Without further elaboration the foregoing will so fully illustrate my invention that others may, by applying current or future knowledge, adopt the same for use under various conditions of service.

What is claimed as the invention is:

1. A unitary closure including:

a. an inner cap having a threaded peripheral wall adapted to cooperate with complimentary threads on the neck of a container;

b. an outer skirt having an annular peripheral wall radially aligned with the peripheral wall of the cap and spaced radially from said peripheral wall of said cap;

c. circumferentially spaced-apart, radially extending break-away tabs interconnecting the inner cap to the outer skirt;

d. first abutment means on the outer skirt;

e. abutment means on the inner cap;

f. said first abutment means on the skirt and abutment means on the cap having first cooperating surfaces for engaging each other to cause said inner cap and outer skirt to rotate together as said closure is being secured onto the neck of a container, to thereby prevent fracturing of the break-away tabs; and g. said first abutment means on the skirt and said abutment means on the cap having second cooperating surfaces, one of said second cooperating surfaces being inclined for engaging the other of said second cooperating surfaces to move said outer skirt axially relative to said inner cap as said inner cap is being removed from the neck of the closure, to thereby impose a tab-fracturing force on the break-away tabs.

2. The unitary closure of claim 1 including second abutment means on said skirt, said second abutment means including a lower surface means adjacent a lower end of said skirt for engaging a cooperating surface of a locking member on a container to which the closure is adapted to be secured for imposing a vertically upward force on the skirt when said closure is rotated in a direction to remove said closure from the container.

3. The unitary closure of claim 2 wherein said second abutment means has an inclined surface for riding over a generally vertically oriented surface of said locking member on the container, and a locking surface disposed at an angle to said inclined surface for cooperating with a locking surface on the locking member, the cooperation of the locking surface of the second abutment means with the locking surface of the locking member on the container confining movement of the second abutment means relative to the locking member when the closure is unscrewed from the neck of the bottle to a path of travel wherein the lower surface means of the second abutment means moves along the cooperating surface of the locking member on the container to impose said vertically upward force on the skirt.

4. The unitary closure of claim 2 wherein said first abutment means are circumferentially spaced-apart about the skirt, and said second abutment means are axially oriented and are in axial alignment with the circumferentially spaced-apart first abutment means on the skirt.

5. The unitary closure of claim 1 wherein the inclined second cooperating surface is part of the abutment means on the inner cap, and is inclined upwardly in the direction in which the closure is rotated to remove said closure from the neck of the container.

6. The unitary closure of claim 1 wherein the abutment means on the inner cap extend generally radially from the outer peripheral surface thereof and are circumferentially spaced-apart from each other, said break-away tabs being attached to the outer periphery of the inner cap in regions between the circumferentially spaced-apart abutment means.

7. The unitary closure of claim 6 wherein the first abutment means on the skirt extend radially inwardly from the inner peripheral wall of said skirt and are circumferentially spaced-apart in circumferential offset relationship to the radially extending abutment means on the cap.

8. A unitary container having an upper neck, said neck having a threaded upper section, a circumferential collar below said threaded section and extending radially outwardly beyond said threads, and a plurality of circumferentially spaced-apart locking members below said circumferential collar, said locking members each including a portion extending radially beyond the periphery of said collar, said portion including a locking surface facing in a direction corresponding to the direction in which a closure is rotated to fasten said closure to the threaded neck, and an inclined surface joined to said locking surface and being inclined upwardly in a direction opposed to the direction in which the locking surface faces, said inclined surface terminating adjacent a lower surface of the collar.

9. The container of claim 8 wherein said collar is circumferentially continuous.

10. The container of claim 8 wherein said portion of the locking members extending radially beyond the circumferential collar each include a generally vertically oriented rounded edge joined to said locking surface through a generally vertically oriented wall facing in a direction radially outward from the neck of the container.

* * * * *